United States Patent [19]

Krasuski et al.

[11] Patent Number: 4,840,696

[45] **Date of Patent: * Jun. 20, 1989**

[54] LABEL DISPENSER AND A FRANKING MACHINE EQUIPPED WITH SAID DISPENSER

[75] Inventors: Marek Krasuski, Fontenay Aux Roses; Jean-Pierre Grégoire, Bagneux; Claude Gerbaud, Massy, all of France

[73] Assignee: SMH Alcatel, Paris, France

[ * ] Notice: The portion of the term of this patent subsequent to Mar. 24, 2004 has been disclaimed.

[21] Appl. No.: 105,479

[22] Filed: Oct. 5, 1987

Related U.S. Application Data

[63] Continuation of Ser. No. 855,258, Apr. 24, 1986, Pat. No. 4,652,330.

[30] Foreign Application Priority Data

Apr. 24, 1985 [FR] France ..... 85 06266

[51] Int. Cl.[4] ..... B65H 26/00

[52] U.S. Cl. ..... 156/353; 156/361; 83/209; 83/211; 83/243; 83/363; 83/364; 83/370

[58] Field of Search ..... 156/353, 354, 355, 361, 156/387; 83/72, 209, 210, 211, 241, 243, 360, 363, 364, 370, 246

[56] References Cited

U.S. PATENT DOCUMENTS

| | | | |
|---|---|---|---|
| 2,001,287 | 5/1935 | Ryan . | |
| 3,011,375 | 12/1961 | Müller | 83/346 X |
| 3,855,041 | 12/1974 | Kunisch . | |
| 3,885,482 | 5/1975 | Denzin . | |
| 4,193,330 | 3/1980 | Knox | 83/364 |
| 4,367,666 | 1/1983 | Toth | 83/203 |
| 4,381,705 | 5/1983 | Roes et al. . | |
| 4,386,860 | 6/1983 | Price . | |
| 4,652,330 | 3/1987 | Gerbaud et al. | 156/361 |
| 4,664,005 | 5/1987 | Peyre | 83/246 X |

FOREIGN PATENT DOCUMENTS

| | | |
|---|---|---|
| 1327663 | 4/1963 | France . |
| 1600861 | 9/1970 | France . |
| 2143356 | 2/1985 | United Kingdom . |

*Primary Examiner*—Michael W. Ball
*Assistant Examiner*—Jeff H. Aftergut
*Attorney, Agent, or Firm*—Sughrue, Mion, Zinn, Macpeak and Seas

[57] ABSTRACT

The label dispenser comprises a cutter (11) for cutting a label from a continuous tape (1), with first and second means (10, 12) disposed on either side of said cutter for holding and for driving said tape. The dispenser further includes cells (25, 26) for detecting tape advance relative to the cutter in order to place the tape in an initial position at a desired label length from said cutter, together with ejector means (30) for ejecting a label cut from said tape, said ejector means causing said label to advance at a higher speed than the tape advance speed. A franking machine fitted with the detector includes a detector for detecting the position of a lever which controls the printing of an optional slogan on the label, and the length label selected in said dispenser is controlled as a function of the detected position of said slogan conrolling lever.

14 Claims, 2 Drawing Sheets

LABEL DISPENSER AND A FRANKING MACHINE EQUIPPED WITH SAID DISPENSER

This is a continuation of application Ser. No. 855,258 filed Apr. 24, 1986 now U.S. Pat. No. 4,652,330.

This application relates to copending application Ser. No. 885,259, filed Apr. 24, 1986 and entitled "A Label Selector for Franking Machine" and assigned to the common corporate assignee.

The present invention relates to label dispensers for automatically dispensing labels taken from a continuous tape mounted as a reel, with said label dispenser being intended, in particular, for use in machines which print labels of different lengths, the invention also relates to franking machines equipped with such label dispensers.

BACKGROUND OF THE INVENTION

In conventional manner, the tape from which labels are taken may be initially scored or perforated to leave lines of weakness between successive label blanks. The tape is carried by a support strip from which labels are readily removable one after the other. In franking machines equipped with a label dispenser using this type of label-making tape, the support strip is driven intermittently in order to bring the labels it supports successively under a print head. After the labels have been printed, a separator member removes them from the support strip.

Labels taken from such a tape are all of the same length as determined by the spacing between successive lines of weakness. The labels cannot thus be of selected size in order to provide the franking machine with short labels when the information printed on the label concerns date and postage paid only, or with long labels when the franking machine is required to print the above information together with additional information, such as a slogan, for example.

In order to avoid this drawback, the label-making tape may be continuous and cut on request to the desired label length. In such automatic dispensers, the tape is driven intermittently to release a first or a second desired length of tape which is cut by a cutter prior to printing so that successive labels of suitable length are delivered to the printer. Different cams may be used for selecting one or other of the two available lengths of tape, depending on the message to be printed thereon. Such selection is controlled from outside the dispenser by an operator who selects label lengths to match the desired print lengths.

In such dispensers of labels of selectable length, the selective tape drive mechanisms are usually complex and bulky. In addition they must be associated with means for holding the tape and with means for driving the labels after they have been out from the tape and prior to being printed. The mechanical complexity of such dispensers also leads to reduced reliability.

Preferred embodiments of the present invention provide a label dispenser suitable, in particular, for use in a franking machine, such a dispenser being of considerably reduced complexity and highly reliable in operation and compatible with the printing speed of current franking machines, in addition, the overall franking machine including such a dispenser is capable of being directly controlled in a highly flexible manner when it comes to selecting labels for printing.

SUMMARY OF THE INVENTION

The present invention provides a label dispenser for selectively dispensing labels of different lengths from a continuous tape, the dispenser comprising a cutter and drive means for intermittently driving the tape, said drive means and cutter being mounted on a tape guide path, said dispenser further including control means for controlling said intermittent drive means and said cutter, the dispenser including the improvement whereby said intermittent drive means include means mounted relative to the cutter suitable for ensuring that said tape is held stationary or driven at a given tape advance speed simultaneously from points located both upstream and downstream from said cutter, said dispenser further including a first cell for detecting the leading end of the tape on its guide path at a position which is located at a distance downstream from said cutter, with said distance being no greater than the length of the shortest selectable label, and second cells for detecting the advance of the tape from its initial position, said second cells being mounted downstream from said cutter at respective distances equal to different label lengths, said first and second cells being connected to said control means, and said dispenser further including ejector means for ejecting each cutoff label at an ejection speed greater than said tape advance speed, said ejector means being mounted downstream from at least said first cell and being separated from said drive means by a distance which is less than the length of the shortest labels.

Said first cell may be mounted downstream from said drive means and at a distance from said cutter equal to the length of the shortest labels.

Advantageously, the distance between said cutter and said means for holding and driving said tape located downstream from said cutter is slightly less than the length of the shortest labels.

Preferably, said ejector means are mounted downstream from said first and second cells and are coupled to drive means which drive them continuously.

Also preferably, said drive means are constituted by respective drive wheels which are coupled to a common tape advance motor, and the down stream wheel is mounted on a free-wheel mechanism.

The present invention also provides a franking machine comprising a print head fitted with first means for printing postage information and second means for printing additional or "slogan" information, together with a slogan control lever, said lever being coupled to said second means and being operable between a first position in which no slogan is printed and a second position in which a slogan is printed, said franking machine including a label dispenser as defined above, and including the improvement of a detector for detecting the position of said slogan lever, said detector being connected to said control means to deliver an automatic select signal for selecting short labels or long labels depending on said detected position.

The slogan lever position detector may be constituted by an opto-electronic emitter-receiver head mounted at a distance from the lever, in which case the lever is fitted with a mirror.

In the franking machine, print head drive means are coupled to the means for ejecting a label cut from the tape, and a third tape detector cell is used to trigger printing on the label.

BRIEF DESCRIPTION OF THE DRAWINGS

An embodiment of the invention is described by way of example, with reference to the accompanying drawings, in which.

DETAILED DESCRIPTION OF PREFERRED EMBODIMENTS

Figure 1:
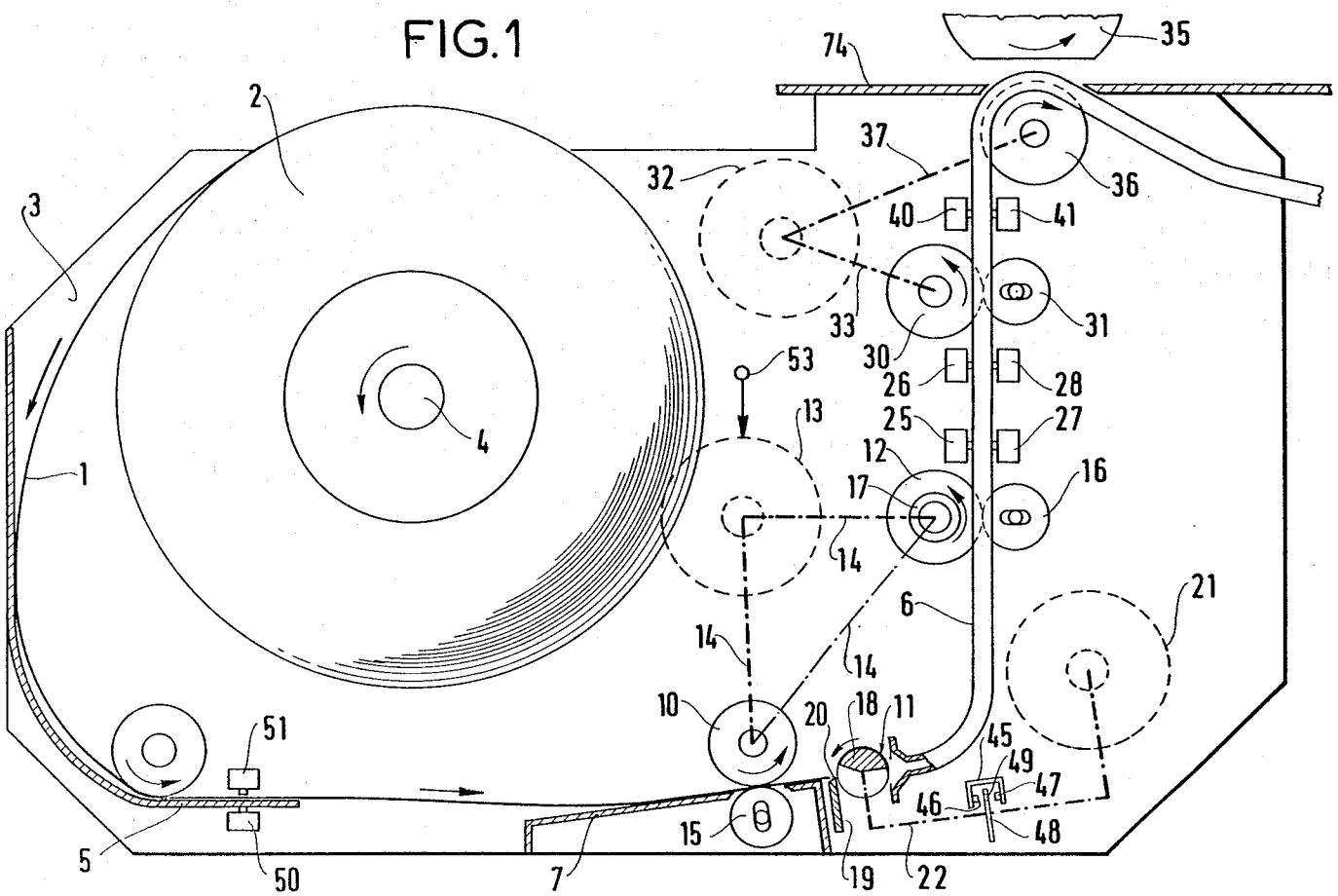
FIG. 1 shows a preferred embodiment of a label dispenser in accordance with the invention.

FIG. 1 shows a preferred embodiment of a label dispenser for dispensing short and long labels which are taken, on request, from a continuous tape 1 mounted in a reel 2. The dispenser is built on a backing plate 3. The reel 2 of tape is mounted free to rotate on a shaft 4 mounted on the backing plate. The tape from the reel is inserted into a pre-guide passage 5 and then into a guide passage 6, which passages are formed in conventional manner near the edges of the packing plate. The tape is directly inserted into the pre-guide passage 5 by an operator. The guide passage 6 defines a guide path for the tape and for labels, which path is accessible to an operator so that a tape jam can be cleared, if necessary. A tape access slope 7 serves to guide tape into the passage 6 during insertion. The guide path for tape and for labels is given the same reference numeral in the following description as the guide passage 6.

Running from its upstream end to its downstream end, the guide path 6 is fitted with a first drive wheel 10 located over the end portion of the slope 7, then with a cutter 11, and then with a second drive wheel 12 beyond the slope 11. The two wheels 10 and 12 are at a distance from each other, but their shafts projecting through the back of the plate 3 are coupled together and to a common tape drive motor 13 shown in dashed lines. The coupling between the wheels is shown diagrammatically by dot-dashed lines 14 between the shafts of the wheels and the shaft of the drive motor 13, in order to avoid crowding the figure. Each of the drive wheels 10 and 12 is associated with a corresponding backing wheel, 15 or 16, respectively. These backing wheels are mounted on the backing plate 3. The backing wheels are mounted free to rotate about their axes, and are resiliently urged to press against the corresponding drive wheels, with the passage 6 being provided with suitable windows for receiving the wheels. When driven to rotate in the direction indicated by the arrows, each wheel drives the tape or the label associated therewith as the case may be, and as explained in greater detail below, at a common tape advance speed V1. In order to ensure that the label dispenser works properly when labels are being ejected at an ejection speed V2 greater than the tape advance speed V1, the downstream drive wheel 12 is mounted on a free wheel mechanism shown at 17.

The cutter 11 on the guide path 6 between the drive wheels 10 and 12 comprises a rotary blade 18 and a fixed blade 19 defining a cutting point 20 on the fixed blade. The shaft of the rotary blade is coupled, behind the backing plate 3, to a cutter drive motor 21 which is shown in dashed lines. The coupling is provided by a gear train represented by a dot-dashed line 22 and arranged to cause the rotary blade to rotate in the direction of the arrow when the motor 21 is switched on. When the rotary blade is held in a rest position, it leaves the tape with a free passage between itself and the fixed blade 19. The guide path 6 has windows suitable for receiving the fixed blade 19 and the rotary blade 18.

Advantageously, the distance between the drive wheels 10 and 12 is close to the length of short labels, and the cutter 11 is located relatively close to the upstream drive wheel 10.

Downstream from the drive wheels 10 and 12, the guide path 6 has a first cell 25 and second cell 26 for detecting the arrival of the leading end of the tape 1 in their immediate vicinity. These detector cells are photoelectric cells and each of them is associated with a photo element 27 or 28 disposed on the opposite side of the guide path, which path has transparent windows provided therefor. The first detector cell 25 is disposed at a distance from the cutting point 20 suitable for defining short labels. It serves to detect when the tape is in the right position for cutting a short label and also defines an initial position for the tape in the guide path. The second detector cell 26 is at a distance from the cutting point 20 suitable for defining a long label. It is used for detecting when the tape is in a suitable position for cutting off a long label.

Given the relative disposition of the drive wheels 10 and 2, and of the cutter 11, which disposition is preferably as shown in the drawings, the first cell 25 is located downstream from the wheel 12, but is fairly close thereto. The second cell 6 is at a distance from the first which corresponds to the difference between the lengths of short labels and long labels.

Downstream from the detector cells 25 and 26, the guide path further includes an ejector wheel 30 for ejecting the labels cut from the tape. The ejector wheel 30 is associated with a backing wheel 31 which is mounted free to rotate about its axis and which is resiliently urged against the ejector wheel 30. The ejector wheel 30 and the associated backing wheel 31 penetrate into the guide path 6 and each of them cooperates with a suitable window provided for that purpose. The wheels 30 and 31 are mounted close to the second detector cell 26 and at a distance from the downstream drive wheel 12 which is less than the length of short labels. This disposition is made possible by the fact that the difference in length between short labels and long labels is less than the length of short labels and it ensures that each short label is always in contact with at least one of the wheels 12 and 30 (and the associated backing wheels) while the label is being dispensed. The shaft of the ejector wheel 30 is coupled behind the backing plate 3 to a drive motor 32 which is independent from the tape drive motor 13. The motor 32 is shown in dashed lines and its coupling with the shaft of the ejector wheel 31 is represented by dot-dashed lines 33. The motor 32 drives the ejector wheel 30 in the direction of the arrow marked on the wheel continuously and serves to drive labels at the ejection speed V2 which is greater than the tape advance speed V1.

The ejection speed V2 is advantageously synchronous with the speed of the franking machine print head to which the labels are dispensed. Under these conditions, and as shown in the figure where the print drum 35 and the backing roll 36 of such a machine are shown diagrammatically, the drive motor 32 for the ejector wheel 30 is the same motor as is used for driving the print backing roll 36. A dot-dashed link 37 between the motor 32 and the print backing roll 36 serves, in conjunction with the connection 33, to ensure that the ejector wheel 30 is driven synchronously with the print backing roll 36 of the franking machine.

The guide path 6 of the dispenser terminates downstream from the ejector wheel 30 and tangentially against the periphery of the print backing roll 36, thereby constituting an outlet for feeding labels from the label dispenser. An additional guide slope (not shown) may be mounted at said label outlet to guide labels against the print backing roll. A third photosensitive cell 40 for detecting the passage of a label, together with its associated photo element 41 are mounted on the guide path 6 between the ejection wheel 30 and the outlet from the label dispenser against the print backing roll 36. When the cell 40 detects the arrival of a label it causes the franking machine to start printing, i.e. to start rotating the print drum 35 in the direction of the arrow marked thereon. This printing control and the corresponding means for putting it into effect do not form a part of the present invention, and is not described in greater detail herein since such equipment is conventional.

In order to ensure that the label dispenser operates correctly and synchronously with the print head, the cutter 11 is associated with a rest position detector. Such a detector is conventional, and may be constituted, for example, by a two-arm optical fork 45 mounted on the frame of the machine on the coupling 22 between the motor 21 and the cutter 11. One arm of the fork has a photo detector 46 and the other a photo element 45, and a notched shutter disk 48 brings a notch 49 between the arms of the optical fork when the cutter 11 is in a predetermined position. This position is the rest position and its detection is used for ensuring that the cutter is properly placed before starting and also for turning the cutter off.

Also, in order to ensure that the apparatus operates properly, the tape pre-guide passage 5 is equipped with a cell 50 associated with an emitter element 51 for detecting the end of the tape, i.e. when the dispenser reel has run out. The cell 50 is arranged to inhibit further operation of the dispenser.

In addition to loading the dispenser, and in particular to suitably inserting the tape into the guide passage 6, manual control as indicated by arrow 53 associated with the tape advance motor 13 is used for turning the motor 13 on and for driving the wheels 10 and 12 to cause the tape to advance along the passage.

Figure 2:
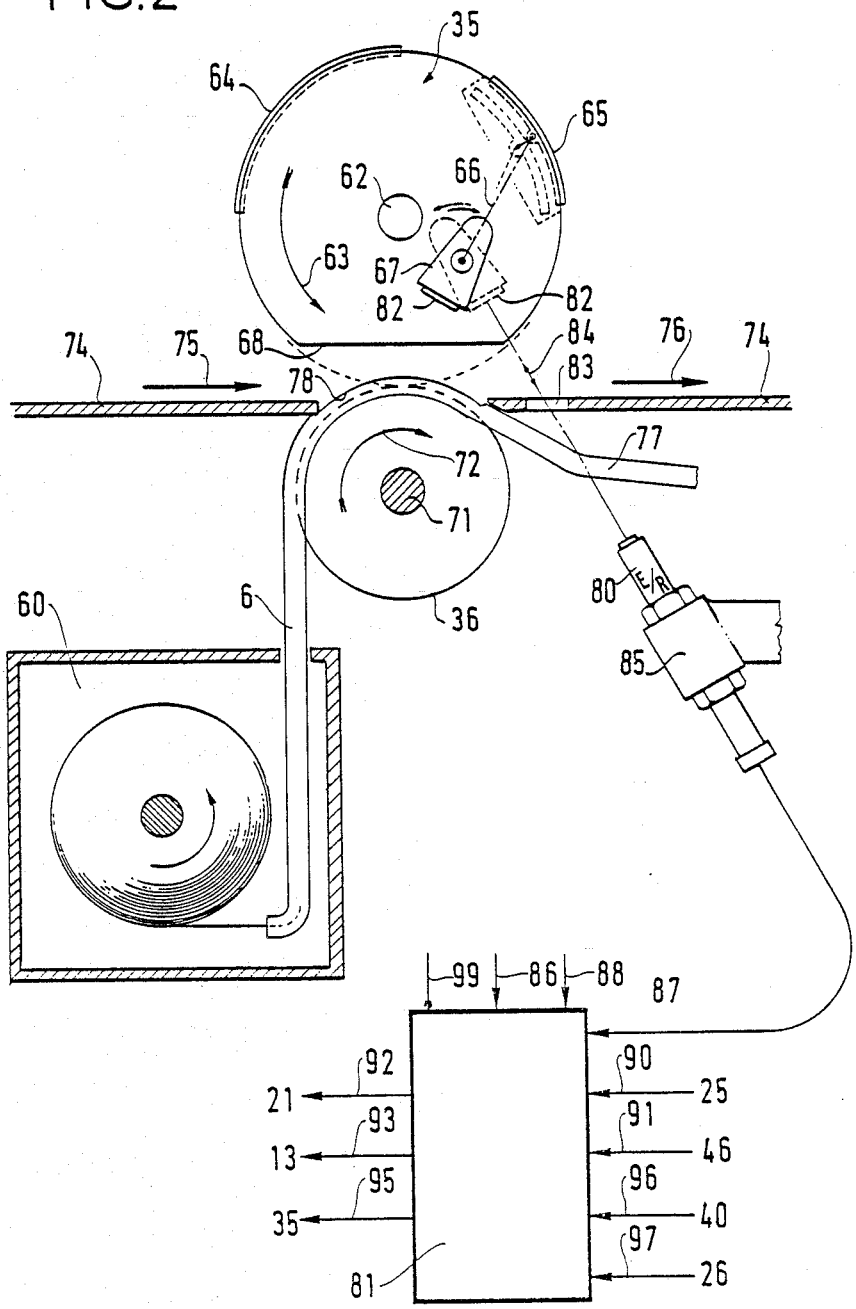
FIG. 2 is a diagram showing a franking machine equipped with said label dispenser.

FIG. 2 is a diagram showing a franking machine coupled to control the dispenser described with reference to FIG. 1. In FIG. 2, the franking machine per se is represented solely by its print drum and its print backing roll, both of which have the same references as before, namely 35 and 36 respectively. The label dispenser is identical to that shown in FIG. 1 and has been given an overall reference 60, with the guide passage for labels to be printed on being designated by the same reference, 6, as before.

The drum 35 is mounted on a shaft 62 and driven to rotate in the direction of arrow 63 during printing.

The drum 35 has a first print plate 64 which is referred to as a postage plate. This first plate 64 is curved and is fixed around a portion of the periphery of the drum. Means for printing the amount of postage, and generally also for printing the date, e.g. by means of print wheels which are located inside the drum and which are of adjustable position, or else by means of an ink jet printer device controlled synchronously with the drum (not shown), are associated with the postage plate 64 for printing variable data through suitable windows provided in said postage printing plate.

The print drum 35 also carries a second curved printing plate 65 which is retractably mounted adjacent to its periphery. This second printing plate 65 is a "slogan" plate and is intended for optionally printing additional information such as an advertising slogan, for example. This slogan plate is connected by an articulated linkage represented symbolically by a dot-dashed line 66 to a control lever 67. The slogan-controlling lever 67 is mounted on the end of the print drum 35 and is actuated by an operator to take up one of two positions, namely a first position shown in dashed lines in which the slogan plate 65 is retracted (also shown in dashed lines) and a second position shown in solid lines for which the slogan plate 65 is in a non-retracted or printing position (also shown in solid lines).

The print drum has a flat 68 which defines a rest position for the drum and which serves to mark said rest position. The slogan lever is movable between said first and second positions when the drum is in its rest position.

Advantageously, although not shown, end ball type guide means are provided which are resiliently urged against the rear face of the slogan lever 67, and two cylindrical grooves interconnected by a groove in the form of a circular arc are provided in the end face of the drum in order to ensure that said first and second positions of the slogan lever are stable positions.

The print backing roll 36 as driven about its axis 71 in the direction of arrow 72 is mounted beneath the print drum 35, and is support supported by the frame of the machine (not shown). The backing roll 36 is, in practice, resiliently urged to co-operate effectively with the drum during printing. When the print head is in its relative position, the drum flat 68 is opposite to the backing roll and a relatively large gap is left between said members.

In the franking machine, an "envelope" table 74 defines a path for guiding an driving envelopes between the print drum 35 and the print backing roll 36. Envelopes are driven along arrow 75 between the drum and the backing roll. After they have been printed on, envelopes are ejected in the direction of arrow 76.

In the franking machine, a passage 77 provides guidance for ejecting printed labels. A path 78 having a window serves to guide labels by their edges only where they pass between the inlet and outlet passages 6 and 77 as they pass over the top of the backing roll under the print drum.

This franking machine together with its label dispenser 60 is also fitted with a selector 80 for selecting short labels or long labels, and an overall control circuit 81 for controlling the dispensing of labels on request, and printing thereon.

The label selector 80 is mounted in such a position relative to the slogan lever 67 as to constitute a remote position detector of said slogan lever. It comprises an emitter E and a receiver R mounted relative to the slogan lever 67 in such a manner as to be coupled to each other only when the lever is in a selected one of its two possible positions, and advantageously when it is in its first position.

In FIG. 2, said emitter and receiver are mounted at a distance from the slogan lever in a single opto-electronic emitter-receiver detector E/R head incorporating or connected to circuits for amplifying and processing the electrical signal output by the receiver. The slogan lever carries a reflecting mirror 82 which receives light from the emitter and returns it to the receiver when the lever 67 is in said first position, which corresponds to the slogan printing plate 65 being in its retracted or non-printing position.

The detector head 80 is mounted beneath the envelope print table 74 which has a window 83 provided therein, which window is transparent to light rays and is located on the light path from the head to the mirror and on the return path from the mirror back to the head. This trajectory is referenced 84, and in the figure it is substantially perpendicular to the mirror when the lever is in its first position. The head 80 has a support 85 for holding the head 80 fixed relative to the frame of the machine.

When the slogan lever 67 is in its first or no-slogan position, the coupling between the emitter and the receiver provided by the mirror 82 causes the head 80 to deliver an output signal representative of a short label being selected. When the slogan lever 67 is in its other or slogan-printing position (as shown in solid lines), the signal delivered by the head 80 represents no coupling between its emitter and receiver, and this signal constitutes a signal for selecting a long label.

In the embodiment described, the label selector is mounted to remotely detect when the slogan lever 67 is in its non-slogan-printing position, i.e. the position in which a short label is required. It is particularly advantageous for this to be the lever position which is detected. Under such circumstances, if the head should malfunction, its output signal will correspond to a long label being selected, even if the lever is in the position which corresponds to a short label being required. As a result, all of the expected printed information will appear on the label, but the label may include blank portions on which there is no slogan. If the opposite situation is taken as the default situation in the event of head failure, short labels will always be presented to the print head, regardless of the amount of information to be printed thereon. This results both in desired information being lost, and in the print backing roll 36 being dirtied by the lost information (for slogans) being printed thereon, instead of on a label.

The control circuit 81 is essentially constituted by means of a microprocessor or of a logic circuit for processing the signals which it receives. Its various possible embodiments are not illustrated or described below since they are readily deduced by the person skilled in the art as a function of the inlet signals which this circuit receives and of the outlet signals which it is required to deliver in response thereto. These signals are described below while describing operation of the label dispenser shown in FIG. 1 and of the franking machine fitted therewith.

The control circuit 81 has an input 82 which is actuated by the operator in order to start up the label dispenser 60 when a label is required. It has an input 87 for receiving the signal which detects when the print drum is in its rest position and an input 88 for receiving a signal from the head 80 representative of the position of the slogan lever 67. Means within the control circuit 81 ensure that the short or long label select signal is taken into account only when the print drum is in its rest position and when there is a request for dispensing a label to be printed on. These means sample or detect the level of the label select signal which is only taken into account immediately prior to the control sequence for taking a label from the continuous tape.

A label of defined length is taken from the tape under the control of the circuit 81 and as a function of the signal from the cell 25 for detecting tape in its initial position. This signal is applied to an input 90. Another necessary precondition is the signal indicating that the cutter is in its rest position as given by the cell 46 and applied to an input 91. When these two signals are present, the sequence for distributing a label of desired length is put into operation.

When a short label is selected for printing, the sequence of operations is as follows:

the tape is cut by the cutter 11 whose motor 21 is activated by a control signal on an output 92 in order to cause the moving blade to perform one complete rotation and stop again in its rest position;

the tape and the cut-off short label are then driven by the drive wheels 10 and 12 as driven by the tape advance motor 13 under the control of a control signal on an output 93 from the circuit 81, and this drive continues until the new end of the tape comes level with the detector cell 25. Simultaneously with this tape advance, the short label as initially pinched between the drive wheel 12 and its backing wheel 16 advances at the tape advance speed V1 until it is pinched between the permanently driven ejector wheel 30 and its backing wheel 31. There is thus a period during which opposite ends of the short label are pinched between respective sets of drive wheels and their associated backing wheels. The free-wheel mechanism provided on the drive wheel 12 immediately allows the label to move forwards at the higher speed V2 rather than at the slower speed V1, thereby moving it away from the new leading end of the tape which is to be detected by the cell 25; and the print head is started, causing the drum 35 to rotate under the control of a signal from an output 95 in response to a signal from the cell 40 received on an input 96 indicating that the label has reached the cell 40.

When a long label is to be delivered and printed on, the above sequences are preceded by an additional tape advance sequence. This additional sequence prior to tape cutting is controlled by the long label select control signal present on input 87 to the control circuit 81. This long label select signal causes the tape advance motor 13 to run until the leading end of the tape arrives at the detector cell 26 which is connected to input 97 of the control circuit 81.

The control circuit 81 also has an inhibit input 99 on which it receives the signal from the cell 50 indicative of no tape left in the dispenser. This inhibit signal prevents the label dispenser from operating and also prevents the print head from operating. Advantageously, the appearance of this inhibit signal may give rise to the residue of the tape being ejected and to a visible or an audible end-of-tape indication being given to the operator.

Thus, as can be seen in the above description of distributor operation, the distributor is not at all complex, mechanically speaking. Its guide path for the tape and for labels cut therefrom is simple, and tape and label advance is under the control of a control circuit suitable for ensuring that the distributor is highly reliable.

In addition, it is particularly easy to load or remove tape and to give an operator access to a jam, should one occur. Furthermore, when used in a franking machine, the distributor makes selection between short labels and long labels both simple and reliable under automatic control.

The present invention has been described with reference to the embodiment illustrated in the drawings. Naturally the invention is not limited thereto. It is obvious that the means specific to the print head should be considered as being merely representative of print heads in general and serving to explain the operation of the dispenser in conjunction with the franking machine fitted therewith. Also, although the particular emitter and receiver opto-electronic head arrangement used for selecting label sizes is advantageous, the invention is not limited to any specific means of remote detection of the position of the slogan lever.

Similarly, although the embodiment of the label dispenser illustrated is the preferred embodiment, it has been given merely by way of example and detail modifications may be made thereto and/or certain means may be replaced by equivalent means, without going beyond the scope of the invention. In particular, it may be observed that the tape is driven and held on both sides of the cutter in such a manner as to ensure that the label is cut from the tape and the tape advances properly, and also that the means for ejecting the cut-off label are separated from the downstream positive drive means by a distance which is less than the length of short labels. In order to satisfy the above condition, the ejection means may be placed between the cells for detecting that the tape has advanced far enough for a short label or a long label rather than being placed downstream from the long label detecting cell. In such an embodiment, the ejection means cannot be continuously driven, but must be driven via a controllable clutch mechanism after the tape has been cut and for as long as required to ensure that the label ejected.

We claim:

1. In a label dispenser for selectively dispensing labels of different lengths from a continuous tape, the dispenser comprising a cutter and intermittent drive means for intermittently driving the tape, said intermittent drive means and cutter being mounted on a tape guide path, said dispenser further including control means for controlling said intermittent drive means and said cutter, the improvement wherein said intermittent drive means includes first drive means upstream of said cutter and second drive means downstream of said cutter for ensuring that said tape is held stationary or driven at the same given tape advance speed from points located both upstream and downstream from said cutter, said dispenser further including a first photoelectric cell for detecting the leading end of the tape on its guide path at an initial position which is located at a distance downstream from said cutter which is no greater than the length of the shortest selectable label, and a second photoelectric cell for detecting the advance of the tape from its initial position, said first and second cells being mounted downstream from said cutter at respective distances equal to different label lengths and being connected to said control means, said dispenser further including independent ejector means for ejecting each cutoff label at an ejection speed greater than said tape advance speed, said ejector means being mounted downstream from at least said first cell and being separated from said second drive means by a distance which is less than the length of the shortest label whereby said intermittent drive means operates to advance the leading end of said continuous tape for severance of labels of different lengths independently of said ejector means and vice versa, and whereby, irrespective of the lengths of the labels cut from said tape, said ejector means operating at an ejection speed greater than said tape advance speed to separate a severed label from the tape to allow said first and second photoelectric cells to detect advance of the tape after passage through the second drive means for controlled severance of a succeeding label of either length.

2. A label dispenser according to claim 1, wherein said first cell is mounted downstream from said drive means and at a distance from said cutter equal to the length of the shortest label.

3. A label dispenser according to claim 1, wherein the distance between said cutter and said means for holding and driving said tape located downstream from said cutter is less than the length of the shortest label.

4. A label dispenser according to claim 1, wherein said ejector means are mounted downstream from said first and second cells, and are coupled to drive means which drive them continuously.

5. A label dispenser according to claim 1, wherein said intermittent drive means which hold and drive the tape simultaneously upstream and downstream from said cutter are constituted by respective drive wheels which are coupled to each other via a coupling link to drive said drive wheels at the same speed and said drive wheels being associated with respective backing wheels.

6. A label dispenser according to claim 5, wherein the drive wheel downstream from the cutter is mounted on a free-wheel mechanism.

7. A label dispenser according to claim 1, wherein said first photoelectric cell defines a rest position for said continuous tape after each ejection of a cut-off label of any length, and also controls the operation of said cutter for cutting a shortest selectable label.

8. A label dispenser according to claim 7, wherein said second photoelectric cell defines an additional length of forward movement of said continuous tape from said initial position and also controls the operation of said knife for a longer length label.

9. In combination, a franking machine and a label dispenser, said label dispenser selectively dispensing labels of different length from a continuous tape, said dispenser comprising a cutter and intermittent drive means for intermittently driving the tape, said drive means and cutter being mounted on a tape guide path, said dispenser further including control means for controlling said intermittent drive means and said cutter, said franking machine comprising a print head fitted with first means for printing postage information and second means for printing additional or "slogan" information, together with a slogan control lever, said lever being coupled to said second means and being operable between a first position in which no slogan is printed and a second position in which a slogan is printed, the improvement wherein: said label dispenser intermittent drive means include means mounted relative to the cutter suitable for insuring that said tape is held stationary or driven at a given tape advance speed at points located both upstream and downstream from said cutter, said dispenser further including a first photoelectric cell for detecting the leading end of the tape on its guide path at an initial position which is located at a distance downstream from said cutter which is no greater than the length of the shortest selectable label, said first and second cells being mounted downstream from said cutter at respective distances equal to different label lengths, said first and second cells being connected to said control means, said dispenser further including ejector means ejecting each cut-off label at an injection speed greater than said tape advance speed, said ejector means being mounted downstream from at least said first cell and being separated from said intermittent drive means by a distance which is less than the length of the shortest label, and wherein said franking machine further comprises a detector for detecting a position of said slogan control lever, said detector being connected to said label dispenser control means to deliver an automatic select signal for selecting short labels or long labels depending upon said detected position.

10. The combination according to claim 9, wherein said slogan lever position detector comprises an emitter and a receiver which are coupled to each other when said slogan lever is in said first position.

11. The combination according to claim 10, wherein said lever position detector is constituted by an emitter-receiver optoelectronic head mounted at a distance from said slogan lever and wherein said slogan lever carries a coupling mirror.

12. The combination according to claim 9, wherein said ejector means from said label dispenser are coupled to means for driving said print head, in such a manner as to ensure that said ejector means and said print head are driven synchronously.

13. The combination according to claim 9, wherein said franking machine includes a third cell located between said print head and said ejector means from said label dispenser, said third cell serving to detect the presence of said labels and to trigger printing thereon.

14. The combination according to claim 9, wherein said control means of said label dispenser are constituted by a microprocessor synchronously controlling both dispensing a label of desired length and printing thereon, said control being based on signals received from said print head and from said label dispenser.

* * * * *